United States Patent [19]

Amano et al.

[11] 4,131,930

[45] Dec. 26, 1978

[54] THERMAL TIME-DELAY SWITCH

[75] Inventors: Matsuo Amano; Sigeyuki Kobori; Toru Sugawara, all of Hitachi, Japan

[73] Assignee: Hitachi, Ltd., Japan

[21] Appl. No.: 787,102

[22] Filed: Apr. 13, 1977

[30] Foreign Application Priority Data

| | | | |
|---|---|---|---|
| Apr. 22, 1976 | [JP] | Japan | 51-46160 |
| Jun. 18, 1976 | [JP] | Japan | 51-71189 |
| Jul. 9, 1976 | [JP] | Japan | 51-80886 |
| Jul. 14, 1976 | [JP] | Japan | 51-82969 |

[51] Int. Cl.[2] ..... H01H 61/02

[52] U.S. Cl. ..... 361/211; 337/99; 337/102

[58] Field of Search ..... 361/163, 164, 211; 337/99–102, 105

[56] References Cited

U.S. PATENT DOCUMENTS

| | | | |
|---|---|---|---|
| 2,302,603 | 11/1942 | Davis et al. | 337/99 X |
| 2,329,119 | 9/1943 | Jacobs | 361/211 |
| 3,108,166 | 10/1963 | Baker et al. | 337/102 X |
| 3,962,665 | 6/1976 | Wojcik et al. | 337/102 |

*Primary Examiner*—Harry E. Moose, Jr.
*Attorney, Agent, or Firm*—Craig & Antonelli

[57] ABSTRACT

A thermal time-delay switch comprises contacts which are normally engaged, a first bimetallic element associated with one of the contacts to separate the contacts from each other with temperature rise in the first bimetallic element, a second bimetallic element associated with the other of the contacts to bring the contacts into engagement with each other with a temperature rise in the second bimetallic element, and a heating resistor provided for each of the first and second bimetallic elements to heat it. The relative displacement between the contacts caused by the first bimetallic element with the temperature rise therein is larger than that caused by the second bimetallic element, so that the contacts are separated from each other substantially independent of voltage fluctuations over a wide range of a voltage source feeding the two heating resistors when the heating resistors have been connected to the voltage source for a given period of time.

3 Claims, 14 Drawing Figures

THERMAL TIME-DELAY SWITCH

BACKGROUND OF THE INVENTION

This invention relates to a thermal time-delay switch and more particularly to a switch with switching contacts operable by means of bimetallic elements.

In the automobile with an electronic fuel control device, an electronic control system for the device operates to make constant the air-fuel ratio of a mixture to be supplied to the engine. When starting the engine, it is necessary to supply a mixture of a high fuel concentration and hence, the fuel supply upon the engine start is carried out through a fuel supplying conduit independent of the electronic control system. The fuel supplying conduit is provided with an electromagnetic valve which is opened for a certain period of time only when the engine is started. Namely, the electromagnetic valve is opened at the time that a starter switch is closed but the valve is closed in about ten seconds after closing the starter switch even if the starter switch is kept closed.

FIG. 1 shows a circuit in which a thermal time-delay switch heretofore in use is used for controlling an electromagnetic valve operable when the engine of the aforementioned automobile is started. A thermal time-delay switch 10 comprises a bimetallic element 12, a heating resistor 14 and contacts 16 and 18. The heating resistor 14 wound on the bimetallic element 12 controls a time at which the contacts 16 and 18 separate. The contact 16 is directly mounted on the bimetallic element so that this bimetallic element serves as a conductor. The contact 18 is connected to one end of the heating resistor 14 and to one polarity of a battery 20.

The thermal time-delay switch 10 is connected to the other polarity of the battery 20 through a starter switch 22 to control the excitation of a coil 24 of electromagnetic valve. Namely, the other end of the heating resistor 14 is connected to the starter switch 22 and the coil 24 is connected between this juncture and the bimetallic element 12, that is, the contact 16. As far as the starter switch 22 is turned on and the contacts 16 and 18 are in engagement, an electrical current is passed through the coil 24.

The battery 20 as a voltage source feeding the thermal time-delay switch 10 is of 12 volts usually but its voltage decreases to 6 volts or less than 6 volts at a low temperature of about — (minus) 30° C. Under this condition, as shown at curve I in FIG. 2, it takes about 110 seconds for the contacts 16 and 18 to be separated from each other after the starter switch 22 is turned on, amounting up to about eleven times as long as a time delay of 10 seconds for 12 volts. If the bimetallic element 12 is designed to have rapid thermal response characteristics with a battery voltage of about 6 volts, in spite of the time delay which is desirably about 10 seconds with a normal battery voltage of 12 volts, it becomes short and undesirable. For this reason, it was inevitable to use a thermal time-delay switch having such a characteristic as shown at curve I in FIG. 2.

In electronic fuel injection control apparatus for the combustion engine of automobile with a thermal time-delay switch of the curve I characteristic, a highly concentrated mixture is injected into the engine upon the engine start, as a result, an exhaust gas is produced which contains a large amount of unburned components. If this undersirable state is prolonged, the ignition plug is wetted and the engine stops operating. Under these conditions, if the starter switch is restarted, a highly concentrated mixture is again injected into the engine, as a result, not only it is impossible to repeat the ignition of the engine but also sometimes a water hammer phenomenon causes the engine to be deformed or to be broken.

SUMMARY OF THE INVENTION

An object of this invention is to provide a thermal time-delay switch which can operate at a substantially constant time delay independent of voltage fluctuations of the voltage source ove a wide range.

Another object of this invention is to provide a thermal time-delay switch wherein once its contacts are switched over, they are ensured of maintaining the present state.

Still another object of this invention is to provide a thermal time-delay switch whose contacts are rendered insensitive to vibrations even when the switch is mounted in a vibratory body such as an automobile.

DETAILED DESCRIPTION OF PREFERRED EMBODIMENTS

Figure 3:
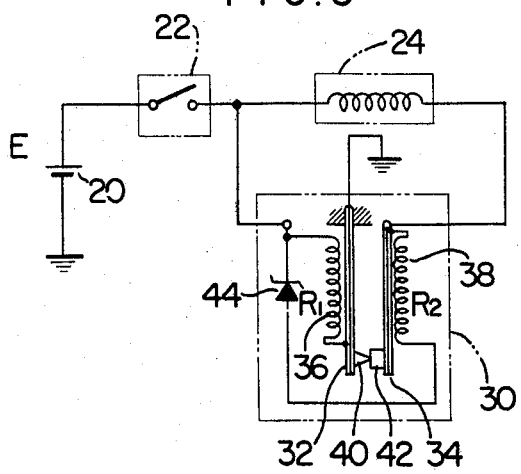
FIG. 3 is a circuit diagram of one embodiment wherein bimetallic elements each having a contact are opposed in pairs.

A thermal time-delay switch 30 embodying the invention as incorporated into a circuit shown in FIG. 3 comprises an operating bimetallic element 32, a compensating bimetallic element 34, an operating heating resistor 36, a compensating heating resistor 38, contacts 40 and 42, and a zener diode 44 acting as an element which becomes conductive when a voltage thereacross exceeds a predetermined voltage.

The compensating bimetallic element 34 with the contact 42 at one end thereof is opposed to the operating bimetallic element 32 with the contact 40 at one end thereof so as to constitute a switch. The operating and compensating bimetallic elements 32 and 34 are wound with the heating resistors 36 and 38, respectively.

The excitation of a load 24 is controlled by the switching operation of the switch constituted by the contacts 40 and 42 respectively fed through the operating bimetallic conductor 32 and the compensating bimetallic conductor 34, the switch being connected in series with the load 24.

The heating resistor 36 has one end connected to the operating bimetallic element 32 and further grounded therethrough. The other end of the heating resistor 36 is connected to a starter switch 22 and this juncture is connected with one end of the heating resistor 38 through the zener diode 44. The heating resistor 38 is connected at the other end with the compensating bimetallic element 34 and the load 24. The load 24 is parallel with individual heating resistors 36 and 38 and the parallel connection is connected to one polarity of a battery 20 through the starter switch 22.

The operating bimetallic element 32 is heated by the heating resistor 36 to separate the contacts 40 and 42, and the compensating bimetallic element 34 is heated by the heating resistor 38 to engage the contacts 40 and 42. That is to say, both the bimetallic elements are moved to the left in view of FIG. 3 with a temperature rise. The zener diode 44 is adapted to enhance the compensation effect of the compensating bimetallic element 34.

In the embodiment of FIG. 3, an electrical current flowing through the zener diode 44 and the heating resistor 38 is interrupted when the contacts 40 and 42 are separated. One the interruption of electrical current occurs, the compensating bimetallic element 34 recovers to the right to further separate the contacts 40 and 42, so that these contacts are prevented from coming in contact again, thereby ensuring a steady switching operation. This means that a thermal time-delay switch can be obtained which is capable of operating stably substantially independent of vibration even when the thermal time-delay switch is supported by a vibratory member. Further, this interruption of electrical current flowing through the zener diode 44 and the heating resistor 38 following the switching operation prevents these elements from being determined by an unwanted electrical current which would flow through them.

Figure 1:
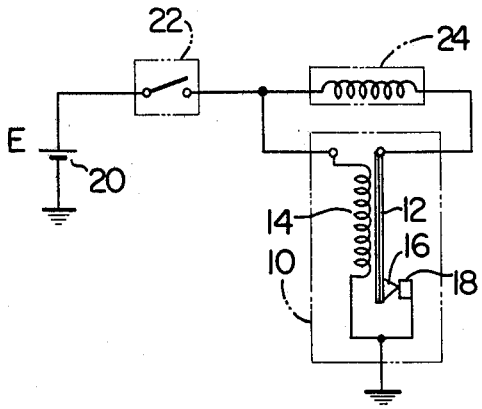
FIG. 1 PRIOR ART
FIG. 1 is a circuit diagram to which a thermal time-delay switch heretofore in use is applied.
Figure 2:
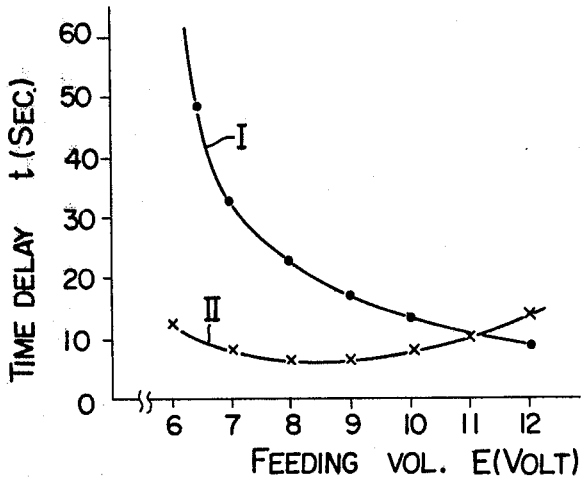
FIG. 2 is a graphic representation showing applied voltage-time delay characteristics obtained with a thermal time-delay switch heretofore in use and a thermal time-delay switch of this invention.

Assuming now that a voltage of battery 20 is E, the resistance of operating heating resistor 36 is $R_1$, the resistance of compensating heating resistor 38 is $R_2$ and the zener voltage of zener diode 44 is $V_z$, the operating bimetallic element 32 receives a quantity of heat proportional to $E^2t/R_1$ whereas the compensating bimetallic element 34 receives a quantity of heat proportional to $(E-V_z)^2t/R_2$, where t represents time. With a zener voltage $V_z$ of 6 volts, the voltage across the compensating heating resistor 38 is 6 volts for a source voltage of 12 volts and is 0 (zero) volt for a source voltage of 6 volts. Consequently, when the feeding voltage exceeds 6 volts, the compensating heating resistor 38 biases the compensating bimetallic element 34 so that the time delay of the thermal time-delay switch 30 is increased as compared with the case where no compensating bimetallic element is used. Therefore, even if the thermal time-dealy switch is so designed as to have a rapid thermal response characteristic with a battery voltage E decreased to about 6 volts, it is possible to obtain a time delay of about 10 seconds with a normal battery voltage of 12 volts. This leads to such a uniform time delay as shown at curve II in FIG. 2 for the variation of feeding voltage over a wide range.

Figure 4:
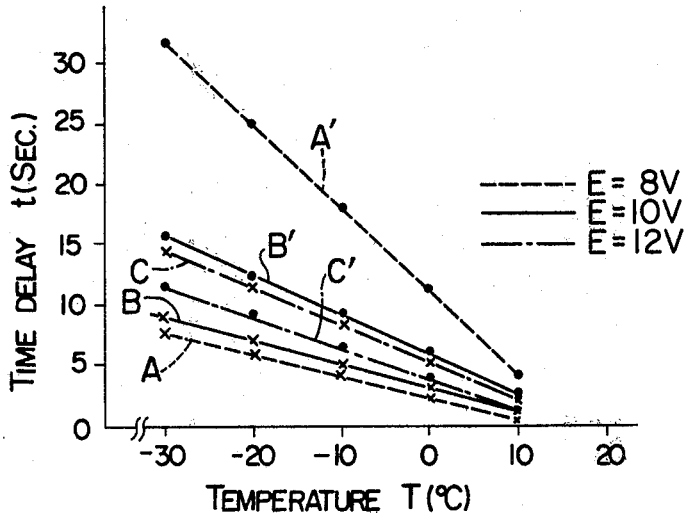
FIG. 4 is a graphic representation showing temperature-time delay characteristics obtained with the circuit heretofore is use shown in FIG. 1 and the circuit of this invention shown in FIG. 3.

FIG. 4 shows experimental results of temperature-time delay characteristics obtained by using the switch of the invention and the prior art one, where curves A, B and C correspond to this invention and curves A', B' and C' correspond to the prior art when the feeding voltage is varied as the parameter from 8 volts to 10 volts and 12 volts.

When the feeding voltage decreases from 12 volts to 8 volts at a temperature of − (minus) 30° C., the difference time delay, that is, time spent until the contacts 40 and 42 separate is 20 seconds for the prior art but only 7 seconds for the present invention. This 7 second difference time delay is determined by the zener voltage of zener diode 44 and the resistance of heating resistor 38 but may be decreased to 1 to 2 seconds by adjusting these values.

As will be seen from the foregoing description, in accordance with the embodiment of FIG. 3, the bimetallic element 32 and 34 can have rapid thermal response characteristics, leading to their small heat capacity. Accordingly, light bimetallic material may satisfactorily be used for the bimetallic elements 32 and 34 and the natural frequency of the respective bimetallic elements can be about twice the natural frequency of a bimetallic element used for the prior art switch. Therefore, it is possible to set the resonance point of the bimetallic element to a higher frequency than 200 Hz, and since an ordinary automobile will produce vibrations of less than 200 Hz, the switching operation of the contacts 40 and 42 is immune to the vibrations due to an automobile.

Figure 5:
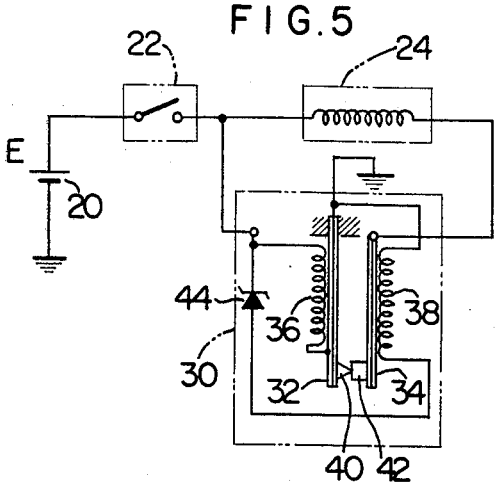
FIG. 5 is a circuit diagram modified from FIG. 3 in accordance with this invention.

In a modification of FIG. 5, in contrast to the embodiment of FIG. 3 wherein the other end of the heating resistor 38 is connected with the compensating bimetallic element 34, the heating resistor 38 is directly grounded without going through bimetallic element 34, contact 42, contact 40 and bimetallic element 32. In accordance with this modification, an electric current flowing through the heating resistor 38 is not interrupted, when the contacts 40 and 42 separate, at the termination of a time-delay period but other advantageous effects can be attained.

Figure 6:
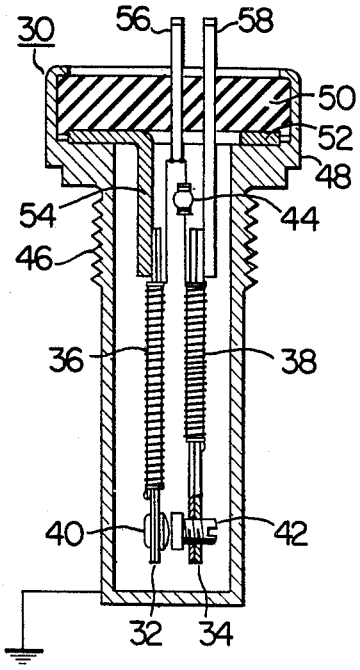
FIG. 6 is a longitudinal sectional view showing a specific construction of the thermal time-delay switch shown in FIG. 3.

Referring to FIG. 6, a thermal time-delay switch is constructed as comprising a casing 48 with a threaded portion 46 and a lid 50 of an insulating material secured to the upper portion of the casing 48. Between the inner wall of the casing 48 and the lid 50 is disposed a plate 52 having a projection 54 to which the operating bimetallic element 32 is connected by spot welding, for example. Passing through the lid 50 are disposed a terminal rod 56 to be connected with the voltage source and a terminal rod 58 to be connected with the load 24. The terminal rod 56 is connected with the other end of the heating resistor 36 and the cathode of the zener diode 44. Connections between the heating resistors 36 and 38 are similar to FIG. 3 and are not detailed herein.

The contact 40 is secured to the operating bimetallic element 32 whereas the contact 42 has a threaded portion by which the contact 42 is screwed to the compensating bimetallic element 34. The threaded portion of contact 42 is provided for adjusting distance between the two contacts and locked by bonding agent, for example, following the adjustment.

It will be appreciated from FIG. 6 that the thermal time-delay switch of this invention which is extermely simple in construction can be manufactured easily and inexpensively. Further, because of the simple construction, the thermal time-delay switch is immune to vibrations and expected to have a prolonged lifetime.

Further, it should be noted that in the electronic fuel injection apparatus, time-delay variations due to fluctuations in the battery voltage at low temperatures can be compensated and the ignition plug of internal combustion engine for automobiles is prevented from being wetted, so that the engine will not be stopped starting thereby maintaining a stable engine start condition. Thus, exhaust gas from the internal combustion engine incorporated with the thermal time-delay switch is pure and clean.

While, in the foregoing description, the heating resistor has been wound on the bimetallic element, the heating resistor may be placed close to the bimetallic element.

The zener diode as a switching element may be substituted by an ordinary diode. In this case, a plurality of diodes may preferably be connected forwardly in series to correspond to the zener voltage of the zener diode.

Figure 7:
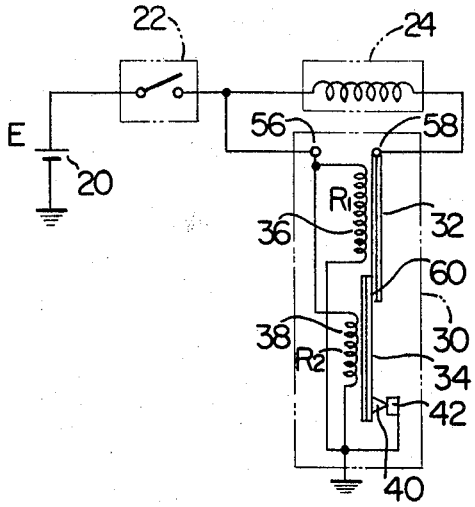
FIGS. 7 through 13 are circuit diagrams showing other embodiments of this invention wherein paired bimetallic elements connected in series are used.

As diagrammatically shown in FIG. 7, according to another embodiment of this invention, an operating bimetallic element 32 is connected with a bimetallic element 34 at a joint 60 in order to compensate time-delay variations due to fluctuations in the feeding voltage by spot welding, for example. The operating bimetallic element 32 and the compensating bimetallic element 34 are wound with an operating heating resistor 36 and a compensating heating resistor 38, respectively. The compensating bimetallic element 34 has a contact 40 fixed thereto and a contact 42 opposes the contact 40. Each of operating heating resistor 36 and compensating heating resistor 38 has one end connected to one polarity of a voltage source 20 through a terminal 56 and the other end grounded. The heating resistors 36 and 38 are parallel with the voltage source. The operating bimetallic element 32 is connected to a load 24 through a terminal 58 and heating by the operating heating resistor 36 to separate the contacts 40 and 42. On the other hand, the compensating bimetallic element 34 is heated by the compensating heating resistor 38 to engage the contacts 40 and 42. In other words, the operating bimetallic element 32 and the compensating bimetallic element 34 are joined at the joint 60 so that higher thermal expansion sides of respective bimetallic elements are opposed to each other. Alternatively, of course, lower thermal expansion sides may be opposed to each other at the joint 60.

With this construction, when a voltage E is fed from the voltage source 20, the operating bimetallic element 32 receives a quantity of heat proportional to $E^2t/R_1$ and the compensating bimetallic element 34 receives a quantity of heat proportional to $E^2t/R_2$, where $R_1$ represent the resistance of heating resistor 36, $R_2$ the resistance of heating resistor 38, and t time. By property determining resistances $R_1$ and $R_2$ as well as the thickness and length of bimetallic elements 32 and 34, thermal response characteristics as shown at curve II in FIG. 2 can be obtained. With a feeding voltage E of 12 volts, the operating bimetallic element 32 acts to separate the contacts 40 and 42 but the compensating bimetallic element 34 acts reversely, thereby prolonging the time required for the contacts 40 and 42 to separate. With a feeding voltage E of 6 volts, quantity of heat received by the operating bimetallic element 32 is reduced to ¼ as compared with the feeding voltage E of 12 volts thereby to prolong the time required for the contacts 40 and 42 to separate, but the quantity of heat received by the compensating bimetallic element 32 operating reversely is also reduced to ¼, so that a resultant time t required for the contacts 40 and 42 to separate is not prolonged excessively. In this manner, time-delay variations due to fluctuations in the feeding voltage can be compensated.

Figure 8:
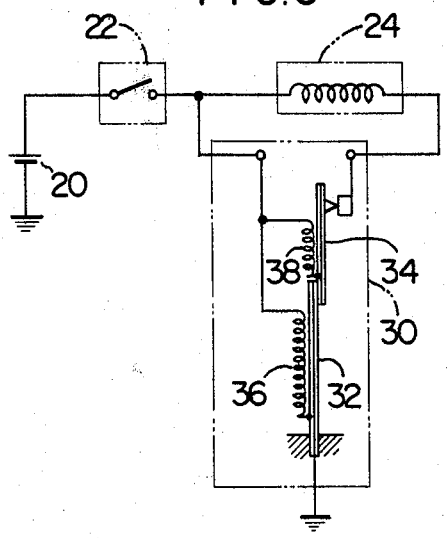
Figure 9:
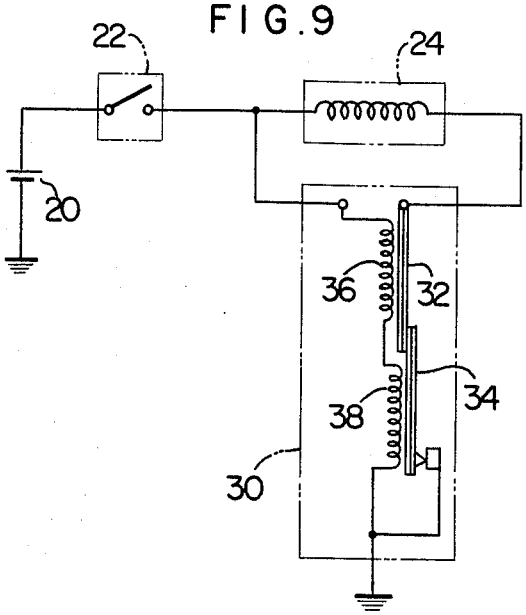

FIGS. 8 and 9 show modifications of FIG. 7 wherein bimetallic elements 32 and 34 are grounded (FIG. 8) and heating resistors 36 and 38 are connected in series (FIG. 9).

In the embodiments shown in FIGS. 7 through 9, the operating bimetallic element 32 supports the compensating bimetallic element 34 but reversely, the compensating bimetallic element 34 may support the operating bimetallic element 32 without impairing the compensation for time-delay variations due to fluctuations in the feeding voltage.

It is also possible to eliminate the compensating heating resistor 38 wound on the compensating bimetallic element 34 since the operating bimetallic element 32 is coupled with the compensating bimetallic element 34 at the joint 60 so that heat generated by the operating heating resistor 36 wound on the operating bimetallic element 32 is also transferred to the compensating bimetallic element 34. This heat transfer can be utilized to compensate time-delay variations due to fluctuations in the feeding voltage.

Figure 10:
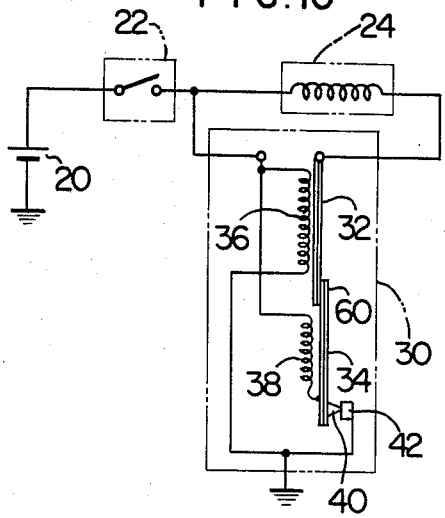

A modification of FIG. 7 as shown in FIG. 10 comprises a compensating heating resistor 38 having one end grounded through contacts 40 and 42.

In this modification, a electric current is passed through the compensating heating resistor 38 until the contacts 40 and 42 separate following the closure of starter switch 22 and is then interrupted. As a result, the compensating bimetallic element 34 deforms to separate the contacts 40 and 42. On the other hand, since an electric current flowing through the operating heating resistor 36 continues during the closure of the starter switch 22, the operating bimetallic element 32 acts to separate the contacts 40 and 42. Thus, the contacts 40 and 42 are freed from hunting and a thermal time-delay switch which offers a stable switching operation can be obtained.

Figure 11:
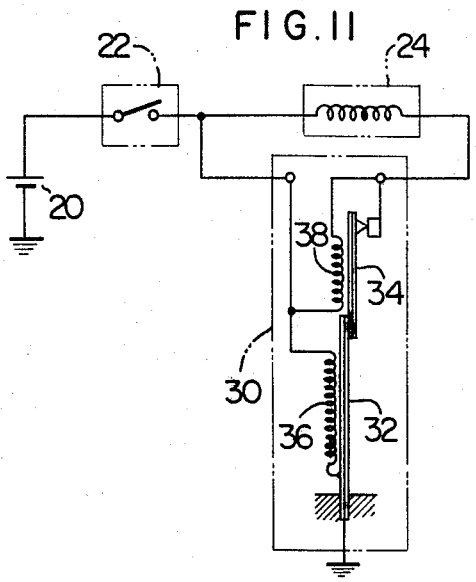

As shown in FIG. 11, a modification of FIG. 10 comprises bimetallic elements 32 and 34 which are grounded.

Figure 12:
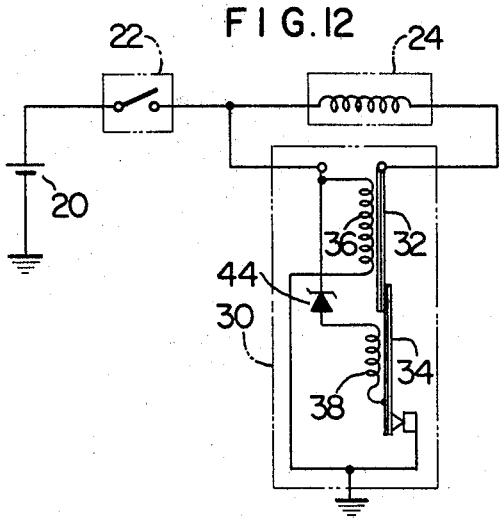

Another modification of FIG. 10, as shown in FIG. 12 comprises a zener diode 44 connected in series with a compensating heating resistor 38. This zener diode is effective not only for the compensation for time-delay variations due to fluctuations in the feeding voltage within feeding voltage fluctuation range which would actually take place but also for protective for the compensating heating resistor 38.

Figure 13:
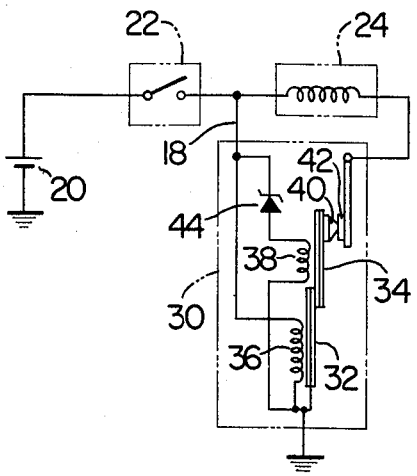

As shown in FIG. 13, the zener diode 44 may be connected in series with the compensating heating resistor 38 shown in FIG. 7 or 8.

Figure 14:
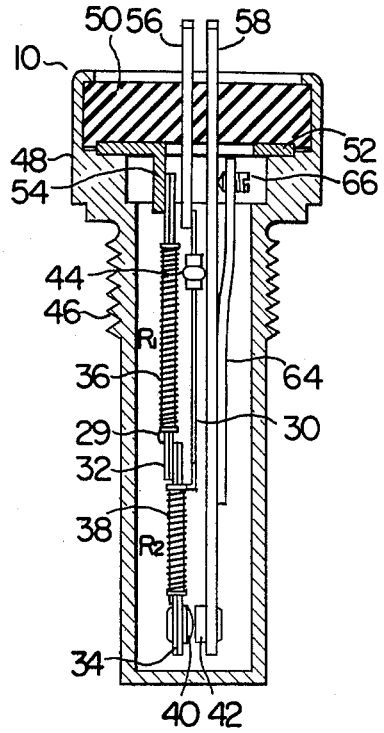
FIG. 14 is a longitudinal sectional view showing a specific construction of the thermal time-delay switch shown in FIG. 13.

Turning now to FIG. 14, a thermal time-delay switch of FIG. 13 is constructed comprising a casing 48 with a threaded portion 46 and a lid 50 of an insulating material secured to the upper portion of the casing 48. Between the inner wall of the casing 48 and the lid 50 is disposed a plate 52 having a projection 54 to which the operating bimetallic element 32 is connected by spot welding, for example. Passing through the lid 50 are disposed a terminal rod 56 to be connected to the voltage source and a terminal rod 58 to be connected to the coil 24. Connected to the terminal rod 56 by soldering are one end of the operating heating resistor 36 and one end of the zener diode 44. The other end of the operating heating resistor 36 is soldered to the operating bimetallic element 32 and the other end of the zener diode 44 is soldered to one end of the compensating heating resistor 38, the other end of which is soldered to the compensating bimetallic element 34. A leaf spring 64 is coupled with the terminal and 58 by spot welding. Distance between the movable contact 40 and the stationary contact 42 is finely adjusted by means of a screw 66 provided for the leaf spring 64 to vary the time required for the contacts to separate.

While, in the foregoing, the normal engaged contacts have been separated, reversely, normally separated contacts may be brought into engagement with a time delay. In this case, an operating bimetallic element is adapted to cause the normally separated contacts to engage with a temperature rise and a compensating bimetallic element is adapted to cause the normally separated contacts to separate with a temperature rise. This modification, however, cannot be applied to the thermal time-delay switches of FIGS. 3, 10, 11 and 12 wherein the electric current is fed to the heating resistor through the contacts 40 and 42.

We claim:

1. A thermal time-delay switch comprising:

a pair of opposed contacts connected in series with a load;

at least one heating resistor connected in parallel with the load;

cooperating bimetallic elements which are heated by said heating resistor comprising a first bimetallic element operable to displace with a temperature rise in a direction in which one of the contacts is separated from the other contact, a second bimetallic element operable to displace with the temperature rise a direction in which one of the contacts is engaged with the other contact, wherein one end of said first bimetallic element is coupled with one end of said second bimetallic element, the other end of one of said first and second bimetallic element is integrally secured to a switch body, and the other end of the other of said first and second bimetallic elements is attached with one of said contacts, and wherein the amount of displacement of the contact due to the temperature rise in the first bimetallic element is different from the amount of displacement of the contact due to the temperature rise in the second bimetallic element so that the contacts are switched with a substantially predetermined time delay substantially independent of fluctuations over a wide range of a voltage feeding said heating resistor; and a contact supporter having one end attached with the other of said contacts and the other end integrally secured to the switch body, said contact supporter including a first strip member integrally secured to the switch body and a second strip member having a free end biased in a direction of said opposing contacts to come into contact with said first strip member, and means disposed in close vicinity of the free end of the second strip member for adjusting the distance between said first and second strip members.

2. A thermal time-delay switch comprising a pair of opposed contacts connected in series with a load, a first bimetallic element operable to displace with a temperature rise in a direction in which one of the contacts is separated from the other contact, a second bimetallic element operable to displace with the temperature rise a direction in which one of the contacts is engaged with the other contact, a first heating resistor for heating said first bimetallic element, and a second heating resistor for heating said second bimetallic element, wherein an element which is rendered conductive by the application of a voltage above a predetermined value is connected in series with the heating resistor for heating one of said first and second bimetallic elements which causes a smaller displacement of the contacts due to the temperature rise than the other so that the contacts are switched with a substantially predetermined time delay substantially independent of fluctuations over a wide range of a voltage feeding said heating resistor.

3. A thermal time-delay switch according to claim 2, wherein said element comprises a zener diode.

* * * * *